United States Patent [19]

Hirano et al.

[11] Patent Number: 4,616,602

[45] Date of Patent: Oct. 14, 1986

[54] COOLING SYSTEM FOR AUTOMOTIVE ENGINE OR THE LIKE

[75] Inventors: Yoshinori Hirano, Yokohama; Takao Kubozuka, Yokosuka, both of Japan

[73] Assignee: Nissan Motor Co., Ltd., Yokohama, Japan

[21] Appl. No.: 751,536

[22] Filed: Jul. 3, 1985

[30] Foreign Application Priority Data

Jul. 6, 1984 [JP] Japan ..... 59-140378

[51] Int. Cl.[4] ..... F01P 3/22; F01P 1/10

[52] U.S. Cl. ..... 123/41.27; 123/41.44

[58] Field of Search ..... 123/41.2–41.27, 123/41.44

[56] References Cited

U.S. PATENT DOCUMENTS 1,787,562 1/1931 Barlow ..... 123/41.44
4,367,699 1/1983 Evans ..... 123/41.49
4,425,766 1/1984 Claypole ..... 236/35
4,549,505 10/1985 Hirano ..... 123/41.21
4,553,505 11/1985 Hirano et al. ..... 123/41.79
4,559,907 12/1985 Hayashi ..... 123/41.44

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to rapidly bring the temperature of the coolant in the coolant jacket of an evaporative type cooling system to a derived target value, both the rate of heat exchange between the condenser or radiator of the system and the surrounding ambient atmospheric air and the amount of coolant in the cooling circuit are varied in a manner to change the pressure and therefore the boiling point of the coolant. With the invention coolant is positively pumped to and from a reservoir which is maintained at atmospheric pressure into and out of a cooling circuit which is hermetically sealed during engine operation.

5 Claims, 18 Drawing Figures

SYSTEM CONTROL ROUTINE

NON-CONDENSIBLE MATTER PURGE CONTROL ROUTINE

TEMPERATURE CONTROL ROUTINE

COOLANT LEVEL CONTROL ROUTINE

CONDENSOR LIQUID LEVEL REDUCTION CONTROL MODE

CONDENSOR LIQUID LEVEL INCREASE CONTROL ROUTINE

SHUT-DOWN CONTROL ROUTINE

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which enables rapid control of pressure prevailing in the cooling circuit thereof so as to offset any undesirable effects on temperature control that sudden changes in ambient conditions might have and which further prevents the intrusion of contaminating air and/or the like non-condensible matter.

2. Description of the Prior Art

In currently used 'water cooled' internal combustion engines such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to come out of solution and form small bubbles in the radiator which adhere to the walls thereof and form an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of 'embolism' in the radiator and which badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proved totally unsatisfactory in that upon boiling of the liquid coolant absorbed into the cramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano. The disclosure of this application is hereby incorporated by reference thereto.

This arrangement while overcomming the problems inherent in the above discussed prior art suffers from the drawback of being overly complex in that a plurality of valves and conduits (valves 134, 152, 156 and 170 and conduits 150, 154 and 168) are required to execute the intended control thereof and further in that, even though provision is made to control the coolant boiling point by varying both the cooling effect provided by the fan 127 and the amount of coolant in the condenser or radiator 126, still the response to sudden changes in ambient conditions has been overly sluggish and thus has exhibited an unacceptable degree of oversensitivity to external influences.

For convenience the same numerals as used in the above mentioned patent application are also used in FIG. 7.

SUMMARY OF THE PRESENT INVENTION

It is an object of the present invention to provide a cooling system for an internal combustion engine or the like device which permits liquid coolant to boil and uses the vapor generated as a vehicle for removing heat from the engine and which features a simple construction which controls the pressure prevailing in the system by positively pumping coolant into or out of the cooling circuit thus ensuring rapid response to sudden deviations in the boiling point from the desired value.

In brief, the above mentioned objects is achieved by an arrangement wherein in order to rapidly bring the temperature of the coolant in the cooling jacket of an evaporative type cooling system, to a derived target value, both the rate of heat exchange between the condenser (or radiator of the system) and the surrounding ambient atmospheric air and the amount of coolant in the cooling circuit are varied in a manner to change the pressure and therefore the boiling point of the coolant; and which particularly features an arrangement whereby the coolant is positively pumped to and from a reservoir which is maintained at atmospheric pressure into and out of a cooling circuit which is hermetically sealed during engine operation.

More specifically, the present invention takes the form of an internal combustion engine having a structure subject to high heat flux; and a cooling circuit for removing heat from the engine which comprises: a coolant jacket formed about the structure, the coolant jacket being arranged to receive coolant in liquid form and discharge same in gaseous form; a radiator in which the gaseous coolant produced in the coolant jacket is condensed to its liquid form; a vapor transfer conduit leading from the coolant jacket to the radiator for transfering gaseous coolant from the coolant jacket to the radiator; a device associated with the radiator for varying the rate of heat exchange between the radiator and a cooling medium surrounding the radiator; a liquid return conduit leading from the radiator to the coolant jacket for returning coolant condensed to its liquid state in the radiator to the coolant jacket; a reservoir the interior of which is maintained constantly at atmospheric pressure; valve and conduit means for selectively interconnecting the reservoir and the cooling circuit, the valve and conduit means including a three-way valve disposed in the return conduit and a level control conduit leading from the three-way valve to the reservoir, the three way valve having a first state wherein fluid communication between the radiator and the coolant jacket is interrupted and communication between the radiator and the reservoir established, and a second state wherein communication between the reservoir and the radiator is interrupted and communication between the radiator and the coolant jacket established; a reversible pump disposed in the coolant return conduit at a location between the radiator and the three-way valve, the pump being selectively energizable to pump coolant in a first flow direction from the radiator toward the three-way valve and in a second flow direction from the three-way valve toward the radiator; a first sensor for sensing a parameter which varies with the temperature of the liquid coolant in the coolant jacket; a second sensor for sensing a parameter which varies with the load on the engine; and a control circuit responsive to the first and second sensors for controlling the operation of the device, the valve and conduit means and the pump, the control circuit including means for: determining the operational mode of the engine; deriving a target temperature at which the liquid coolant in the coolant jacket should be maintained; operating the device in a manner to vary the rate of condensation in the radiator and bring the temperature of the coolant in the coolant jacket to the target temperature, and operating the three-way valve and the pump in a manner to vary the amount of coolant in the cooling circuit and therefore modify the pressure prevailing in the cooling circuit in a manner which tends to being the temperature of the coolant to the target temperature.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the concepts on which the present invention is based.

Figure 1:
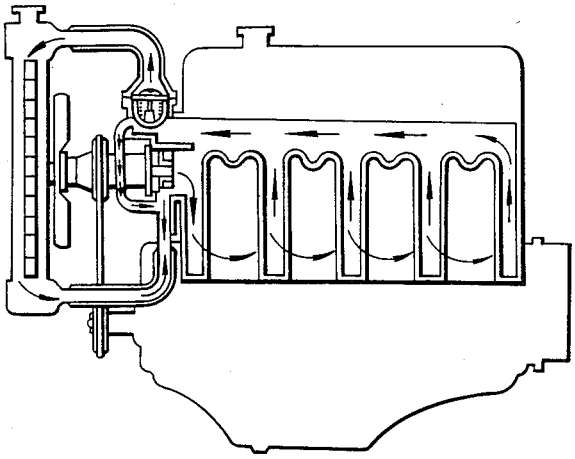
FIG.1 (PRIOR ART)
FIG. 1 is a partially sectioned elevation showing the conventional water circulation type cooling system discussed in the opening paragraphs of the instant disclosure.
Figure 2:
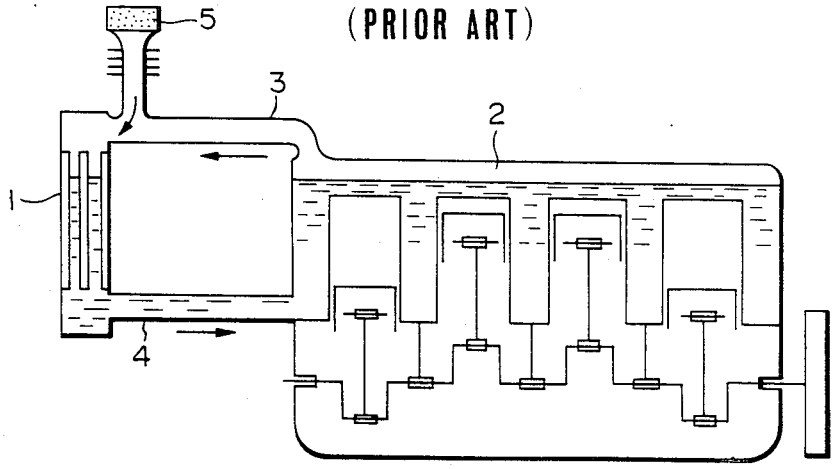
FIG.2 (PRIOR ART)
FIG. 2 is a schematic side sectional elevation of a prior art arrangement also discussed briefly in the earlier part of the specification.
Figure 3:
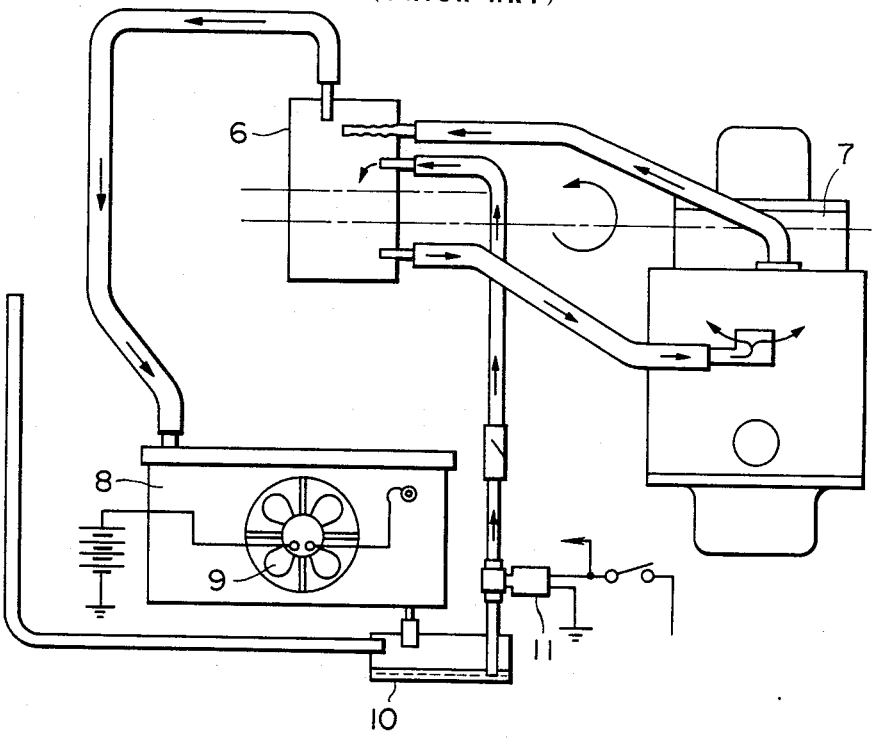
FIG.3 (PRIOR ART)
FIG. 3 shows in schematic layout form, another of the prior art arrangements previously discussed.
Figure 4:
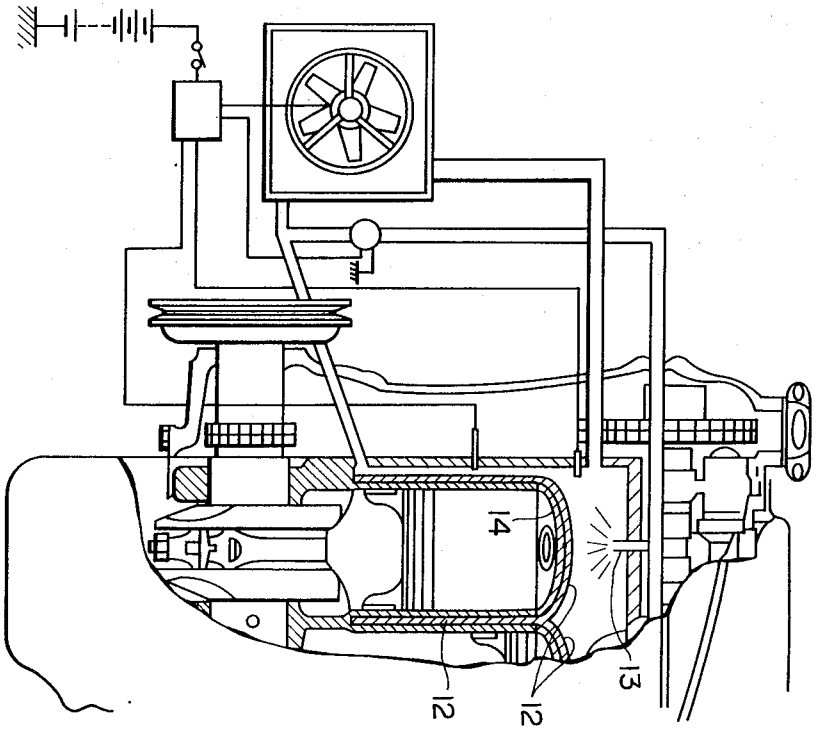
FIG.4 (PRIOR ART)
FIG. 4 shows in partial section yet another of the previously discussed prior art arrangements.
Figure 5:
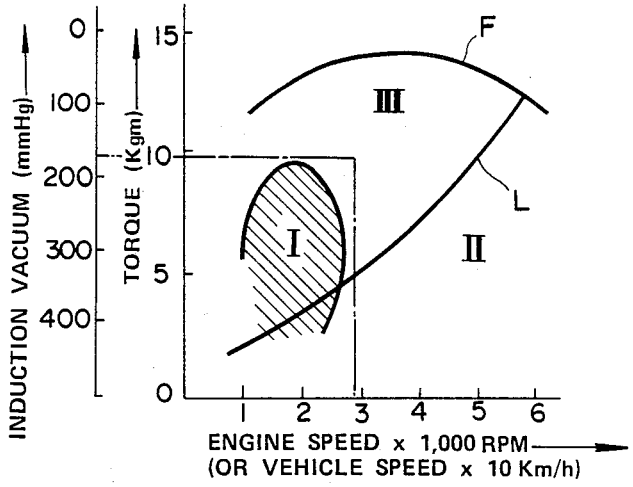
FIG. 5 is a graph showing in terms of induction vacuum (load) and engine speed the various load zones encountered by an automotive internal combustion engine.
Figure 6:
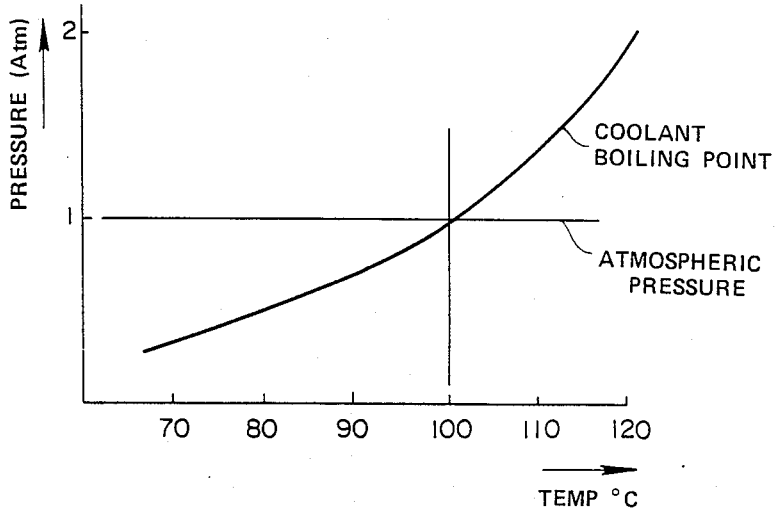
FIG. 6 is a graph showing in terms of pressure and temperature, the change which occurs in the coolant boiling point with change in pressure.

FIG. 5 graphically shows in terms of engine torque and engine speed the various load 'zones' which are encountered by an automotive vehicle engine. In this graph, the curve F denotes full throttle torque characteristics, trace L denotes the resistance encountered when a vehicle is running on a level surface, and zones I, II and III denote respectively 'urban cruising', 'high speed cruising' and 'high load operation' (such as hill-climbing, towing etc.).

A suitable coolant temperature for zone I is approximately 110° C. while 90°-80° C. for zones II and III. The high temperature during 'urban cruising' promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C. if so desired.

Figure 7:
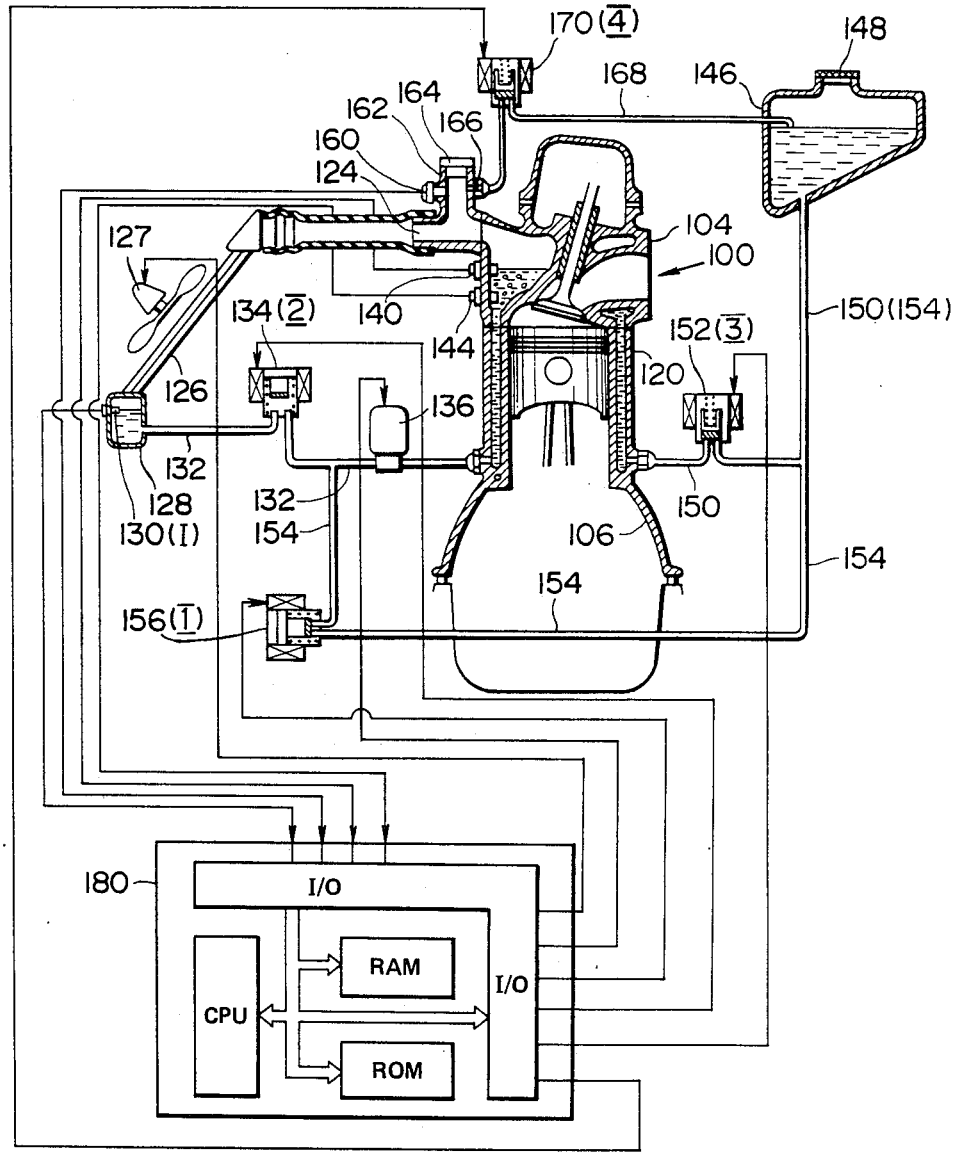
FIG. 7 shows in schematic elevation the arrangement disclosed in the opening paragraphs of the instant disclosure in conjunction with copending U.S. Ser. No. 663,911.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during urban cruising by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres). In addition to the control afforded by the air circulation the present invention is arranged to positively pump coolant into the system so as to vary the amount of coolant actually in the cooling circuit in a manner which modifies the pressure prevailing therein. The combination of the two controls enables the temperature at which the coolant boils to be quickly brought to and held close to that deemed most appropriate for the instant set of operation conditions.

On the other hand, during high speed cruising, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. In addition to this, the present invention also provides for coolant to be positively pumped out of the cooling circuit in a manner which lowers the pressure in the system and supplements the control provide by the fan in a manner which permits the temperature at which the coolant boils to be quickly brought to and held at a level most appropriate for the new set of operating conditions.

However, if the pressure in the system drops to an excessively low level the tendancy for air to find its way into the interior of the cooling circuit becomes excessively high and it is desirable under these circumstances to limit the degree to which a negative pressure is permitted to develop. The present invention controls this by again positively pumping cooling into the cooling circuit while it remains in an essentially hermetically sealed state and raises the pressure in the system to a suitable level.

Figure 8:
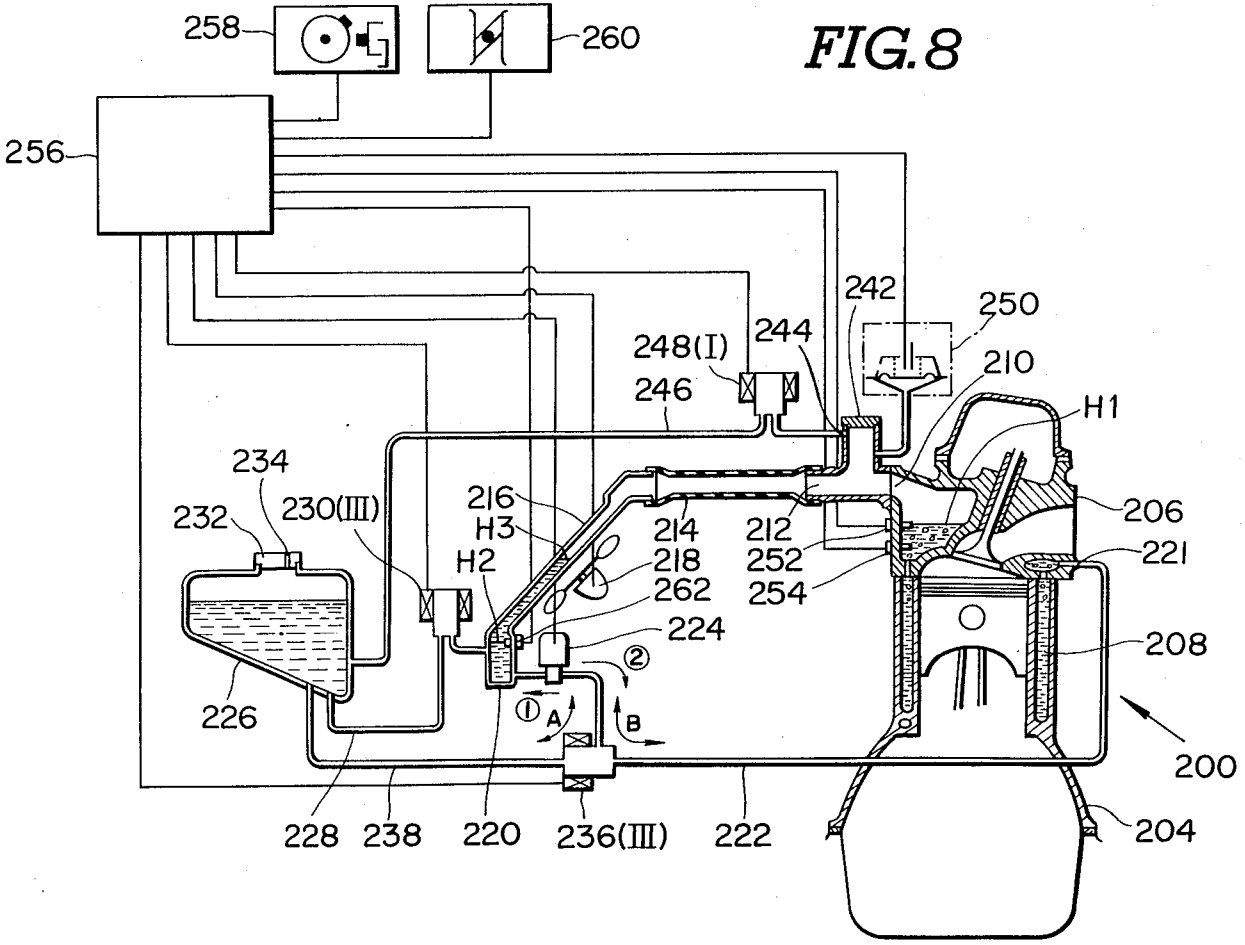
FIG. 8 shows in sectional elevation an embodiment of the present invention.

FIG. 8 of the drawings shows an embodiment of the present invention. In this arrangement an internal combution engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor conduit 214, is a condenser 216 or radiator as it will be referred to hereinafter. Located adjacent the radiator 216 is a selectively energizable electrically driven fan 218 which is arranged to induce a cooling draft of air to pass over the heat exchanging surface of the radiator 216 upon being put into operation.

A small collection reservoir 220 or lower tank as it will be referred to hereinlater is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit at a location relatively close to the radiator 216. According to the present invention, this pump 224 is arranged to reversible—that is energizable so as to induct coolant from the lower tank 220 and pump same toward the coolant jacket 208 (viz., pump coolant in a first flow direction) and energizable so as to pump coolant in the reverse direction (second flow direction )—i.e. induct coolant through the return conduit 222 and pump it into the lower tank 220. The reason for this particular arrangement will become clear hereinlater.

A coolant reservoir 226 is arranged to communicate with the the lower tank 220 via a supply conduit 228 in which an electromagnetic flow control valve 230 is disposed. This valve is arranged to closed when energized. The reservoir 226 is closed by a cap 232 in which a air bleed 234 is formed. This permits the interior of the reservoir 226 to be maintained constantly at atmospheric pressure.

A three-way valve 236 is disposed in the coolant return conduit 222 and arranged to communicate with the reservoir 226 via a level control conduit 238. This valve is arranged to have a first state wherein fluid communication is established between the pump 224 and the reservoir 226 (viz., flow path A) and a second state wherein communication between the pump 224 and the coolant jacket 208 is established (viz., flow path B).

The vapor manifold 212 is formed with a riser portion 240. This riser portion 240 as shown, is provided with a cap 242 which hermetically closes same and further formed with a purge port 244. This latter mentioned port 244 communicates with the reservoir 226 via an overflow conduit 246. A normally closed ON/OFF type electromagnetic valve 248 is disposed in conduit 246 and arranged to be open only when energized. Also communicating with the riser 240 is a pressure differential responsive diaphragm operated switch arrangement 250 which assumes an open state upon the pressure prevailing within the cooling circuit (viz., the coolant jacket 208, vapor manifold 214, vapor conduit 214, radiator 216 and return conduit) dropping below atmospheric pressure by a predetermined amount. In this embodiment the switch 250 is arranged to open upon the pressure in the cooling circuit falling to a level in the order of −30 to −50 mmHg.

In order to control the level of coolant in the coolant jacket, a level sensor 252 is disposed as shown. It will be noted that this sensor 252 is located at a level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature or 'hot spots'.

Located below the level sensor 252 so as to be immersed in the liquid coolant is a temperature sensor 254. The output of the level sensor 252 and the temperature sensor 254 are fed to a control circuit 256 or modulator which is suitably connected with a source of EMF (not shown).

The control circuit 256 further receives an input from the engine distributor 258 (or like device) which outputs a signal indicative of engine speed and an input from a load sensing device 260 such as a throttle valve position sensor. It will be noted that as an alternative to throttle position, the output of an air flow meter, an induction vacuum sensor or the pulse width of fuel injection control signal may be used to indicate load.

A second level sensor 262 is disposed in the lower tank 220 at a level H2. The purpose for the provision of this sensor will become clear hereinafter when a discussion the operation of the embodiment is made with reference to the flow charts of FIGS. 9 to 18

Prior to use the cooling circuit is filled to the brim with coolant (for example water or a mixture of water and antifreeze or the like) and the cap 242 securely set in place to seal the system. A suitable quantity of additional coolant is also placed in the reservoir 226. At this time the electromagnetic valve 230 should be temporarily energized so as to assume a closed condition and three-way valve 236 conditioned to establish flow path B or similar precautions be taken to facilitate the complete filling of the system and the exclusion of any air.

When the engine is started, as the coolant jacket is completely filled with stagnant coolant, the heat produced by the combustion in the combustion chambers cannot be readily released via the radiator 216 to the ambient atmosphere and the coolant rapidly warms and begins to produce coolant vapor. At this time valve 230 is left de-energized (open) whereby the pressure of the coolant vapor begins displacing liquid coolant out of the cooling circuit (viz., the coolant jacket 208, vapor manifold 212, vapor conduit 214, radiator 216, lower tank 220 and return conduit 222).

During this 'coolant displacement mode' it is possible for either of two situations to occur. That is to say, it is possible for the level of coolant in the coolant jacket 208 to be reduced to level H1 before the level in the radiator 216 reaches level H2 or vice versa, viz., wherein the radiator 216 is emptied to level H2 before much of the coolant in the coolant jacket 208 is displaced. In the event that latter occurs (viz., the coolant level in the radiator falls to H2 before that in the coolant jacket reaches H1), valve 230 is temporarily closed and an amount of the excess coolant in the coolant jacket 208 allowed to 'distill' over to the radiator 216 before valve 230 is reopened. Alternatively, if the level H1 is reached first, level sensor 252 induces the energization of pump 224 and coolant is pumped from the lower tank 220 to the coolant jacket 208 while simultaneously being displaced out through conduit 228 to reservoir 226.

During this displacement mode, the load and other operational parameters of the engine (viz., the outputs of the sensors 258 and 260) are sampled and a decision made as to the temperature at which the coolant should be controlled to boil. If the desired temperature is reached before the amount of the coolant in the cooling circuit is reduced to its minimum permissible level (viz., when the coolant in the coolant jacket and the radiator are at levels H1 and H2 respectively) it is possible to energize valve 230 so that is assumes a closed state and places the cooling circuit in a hermetically closed condition. If the temperature at which the coolant boils should exceed that determined to be best suited for the instant set of engine operational conditions, three-way valve 236 may be set to establish flow path A and the pump 224 energized briefly to pump a quantity of coolant out of the cooling circuit to increase the surface 'dry' (internal) surface area of the radiator 216 available for the coolant vapor to release its latent heat of evaporation and to simultaneously lower the pressure prevailing within the cooling circuit. It should be noted however, that upon the coolant in the circuit being reduced to the minimum level (viz., when the levels in the coolant jacket 208 and the lower tank 220 assumes levels H1 and H2 respectively) the displacement of coolant from the circuit is terminated in order to prevent a possible shortage of coolant in the coolant jacket 208.

On the other hand, should the ambient conditions be such that the rate of condensation in the radiator 216 is higher than the desired (viz., overcooled) and the pressure within the system overly lowered to assume a subatmospheric level (for example), three-way valve 236 is conditioned to produce flow path A and the pump 224 operated to induct coolant from the reservoir 226 and force same into the radiator 216 via the lower tank 220 until it reaches level H3 (by way of example). With this measure, the pressure prevailing in the cooling circuit is raised and the surface area available for heat exchange reduced. Accordingly, the boiling point of the coolant is immediately modified by the change in internal pressure while the amount of heat which may be released from the system reduced. Accordingly, it is possible to rapidly elevate the boiling point to that determined to be necessary.

When the engine 200 is stopped it is advantageous to maintain valve 230 energized (viz., closed) until the pressure differential responsive switch arrangement 250 opens. This obviates the problem wherein large amounts of coolant are violently discharged from the cooling circuit due to the presence of superatmospheric pressures therein.

The above briefly disclosed operation will become more clearly understood as the description of the flow charts shown in FIGS. 9 to 18 proceeds. Although not shown in FIG. 8 it is to be understood that control circuit 256 includes a microprocessor of the nature shown in FIG. 7.

Figure 9:
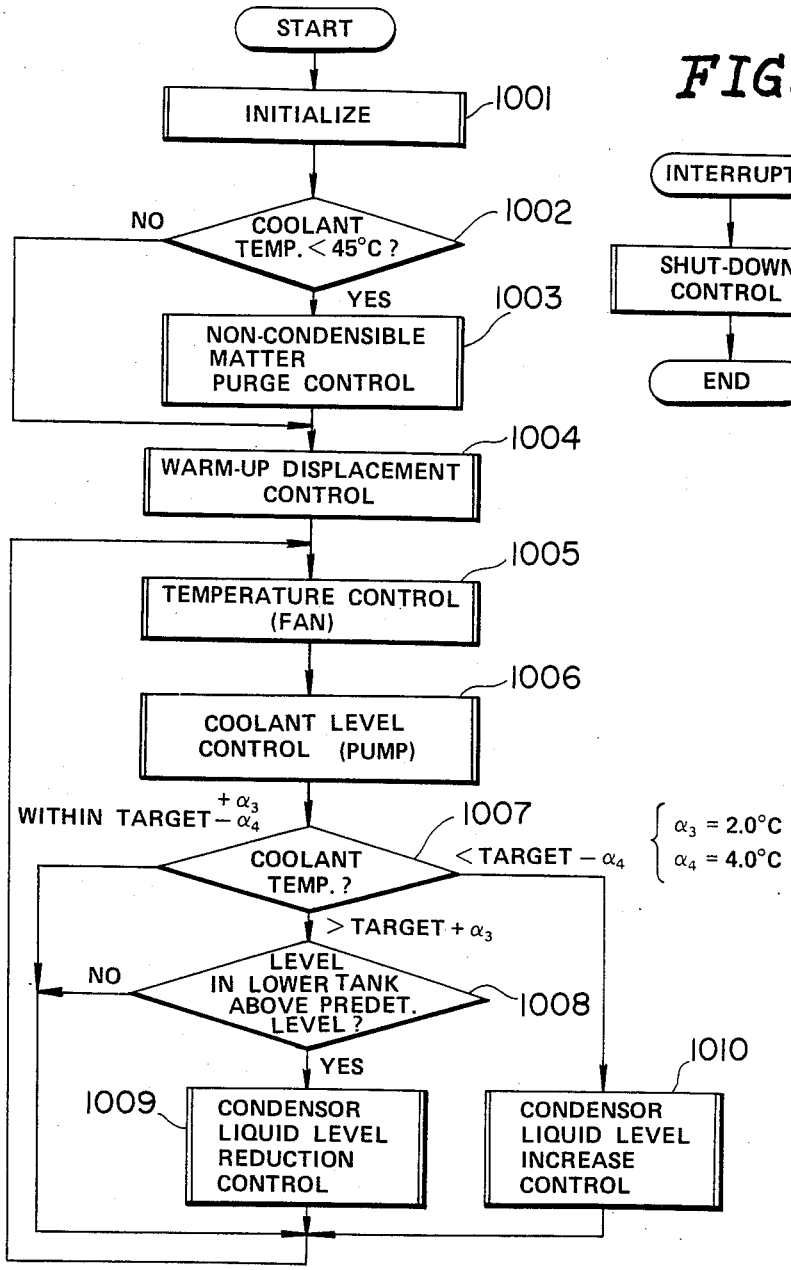
FIGS. 9 to 18 are flow charts depicting the steps which characterize the control of the arrangement shown in FIG. 8.

FIG. 9 shows in flow chart form, the steps which characterize the control system as a whole. As shown at step 1001 of this system control routine the system is initialized (a detailed description of this will be given hereinafter with reference to FIG. 11). Following this the output of temperature sensor 254 is sampled and at step 1002 the determination made as to whether to proceed with the non-condensible matter purge routine or not is executed. As shown in this embodiment if the temperature of the coolant in the coolant jacket 208 is above 45° C. then the engine is deemed to be 'hot' and the purge routine (step 1003) by-passed and a warm up/displacement mode directly entered at step 1004.

Following the displacement mode a first temperature control mode is entered. Viz., a mode wherein the temperature of the coolant is controlled by varying the rate of heat exchange between the radiator 216 and the ambient atmosphere via selective energization of the cooling fan 218. At step 1006 the operation of the pump 224 is controlled in response to the output of level sensor 252 so as to maintain the cylinder head and other highly heated structure of the engine securely immersed in liquid coolant. Following this, the coolant temperature is ranged in step 1007 and control of the amount of the coolant actually contained in the cooling circuit of the system controlled (steps 1008 to 1010) in a manner to vary the pressure and hence the temperature at which the coolant will boil. Each of these routines will be discussed in detail hereinafter.

Figure 10:
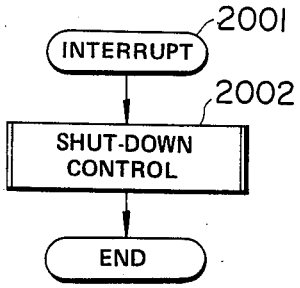

FIG. 10 shows an interrupt routine which is executed in the event that the engine is stopped and the necessity for control which obivates loss of coolant from the system via spillage due to the presence of super atmospheric pressures which tend to prevail in the system due to heat which is accumulated in the engine structure per se, induced. This routine will also be discussed in detail hereinafter.

Figure 11:
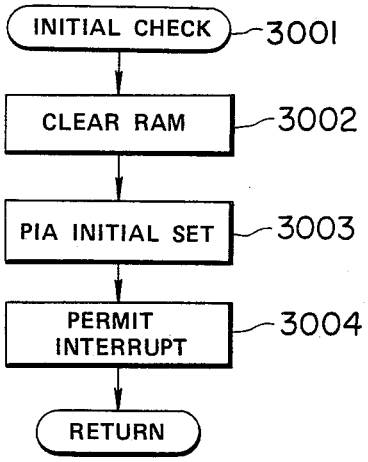

FIG. 11 shows in detail the steps which are conducted in the initialization step 1001 of FIG. 9. In this routine at step 3001 the initial check routine starts, at step 3002 the ram or rams of the mocroprocessor are cleared, as step 3003 the peripheral interface adapter is initially set, and in step 3004 the microprocessor is conditioned to allow interrupts.

Figure 12:
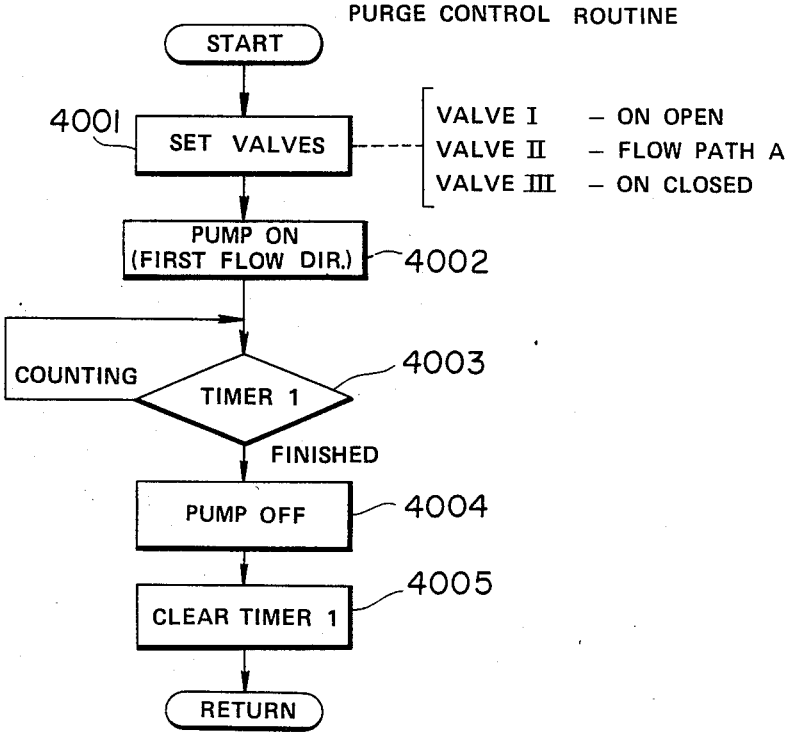

FIG. 12 shows in detail the steps which characterize the control of the non-condensible matter purge mode. At step 4001 the three electromagnetic valves 248, 236 and 230 are conditioned as shown. For the ease of explanation these valves shall be referred to simply as valves I, II and III respectively. Viz. valve I (248) is energized so as to assume an open state and thus permit fluid communication between the riser 240 and the reservoir 226 via overflow conduit 246, valve II (236) set so as to assume a condition wherein flow path A is established (viz., fluid communication between the reservoir 226 and the lower tank 220), and valve III (230) is closed. At step 4002 pump 224 is energized so as to pump coolant in the second flow direction (viz., toward the lower tank). This causes the freshly introduced coolant (from reservoir 226) to flow up through the radiator 216 toward the riser 240 and thus flush out any stubborn bubbles of air that may have found their way into the system and collected in the radiator tubing.

As the cooling circuit is essentially full at this time the excess coolant soon spills oven to the reservoir 226 via the return conduit 246. The operation of pump 224 is maintained for a predetermined period of time (which can be set between several seconds and several tens of seconds—for example from 5 to 60 seconds) by a soft clock or first timer (timer 1) which arranged to count down by one each time a clock pulse or like signal is produced within the microprocessor in which the instant set of programs are being run. While this clock or timer is counting the program recycles to step 4003 as shown. Subsequently, upon the timer having counted down (or alternatively up) by the required amount the program flows on to step 4004 wherein the operation of the pump 224 is stopped and timer 1 (first timer) cleared ready for the next purge operation.

Figure 13:
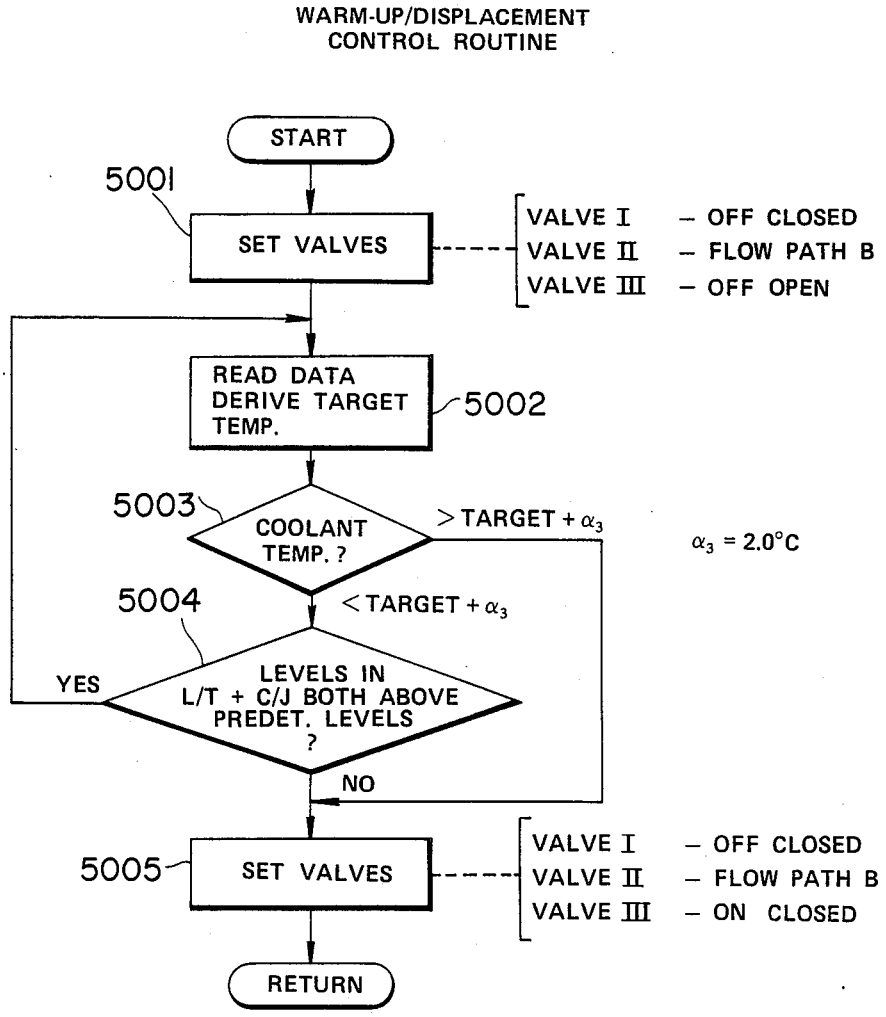

FIG. 13 shows the control steps which characterize the control of the warm-up/displacement control mode of operation. As shown in step 5001 valves I, II and II (i.e. valves 248, 236 and 230) are conditioned in a manner which closes the overflow conduit 246 establishes flow path B and which de-energizes valve III (230) to open conduit 228. At step 5001 the data input from the sensors 258 and 260 are read and a determination made as to the most appropriate temperature for the coolant to be induced to boil, calculated or otherwise suitably looked up. It will be of course understood that it is within the perview of the instant invention to obtain this data via performing a table look using a table of the nature shown in FIG. 5 of the drawings.

At step 5003 the output of the coolant temperature sensor 254 is sampled and compared with the TARGET value determined in step 5002. If the coolant temperature is above TARGET by a value $\alpha 3$ (wherein $\alpha = 2.0°$ C.) then the program flows to step 5005 while in the event the coolant temperature has not come within TARGET$=\alpha 3$ then at step 5004 the output of level sensors 252 and 262 are sampled and it is determined if the level of coolant in both of the coolant jacket 208 (C/J) and the lower tank 220 (L/T) are below levels H1 and H2 respectively. If the outcome of this enquiry is negative, then the coolant circuit still contains an amount of coolant in excess of the above mentioned minimum amount and the program recycles to step 5002 to allow for further displacement. However, if one of the levels has reached the respective predetermined one, then in order to prevent either an excessively low level in the coolant jacket 208 or for the excess coolant in the coolant jacket to be in part moved to the raditator 216 via the previously mentioned 'distilation' process, the valves are conditioned as shown. Viz., valve I is closed, valve II flow path B is established and valve III is energized to assume a closed state.

Figure 14:
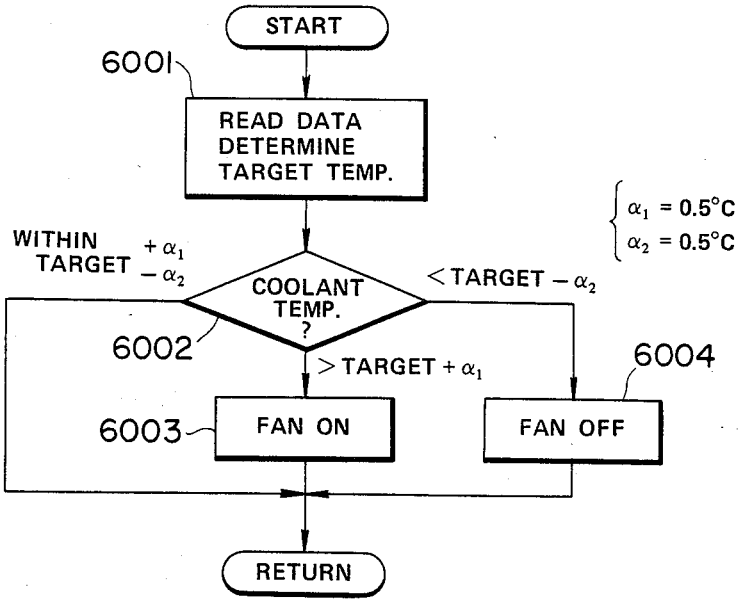

Following the termination of the warm-up/displacment control mode the temperature control (fan) program is run. As shown in FIG. 14, at step 6001 of this routine the data inputs from sensors 258 and 260 are read and and the TARGET temperature determined.

At step 6002 the instant coolant temperature is determined by sampling the output of temperature sensor 254 and compared with the derived TARGET value. The temperature is ranged as shown. Accordingly, if the instant coolant temperature is within a range of TARGET+$\alpha$1 to TARGET−$\alpha$3 (wherein $\alpha$1=0.5° C.=$\alpha$2) then the routine terminates. However, if the temperature is lower than TARGET−$\alpha$2 then the operation of the cooling fan 218 is prevented while if above TARGET+$\alpha$1 then at step 6003 the operation of the fan 218 is induced.

Figure 15:
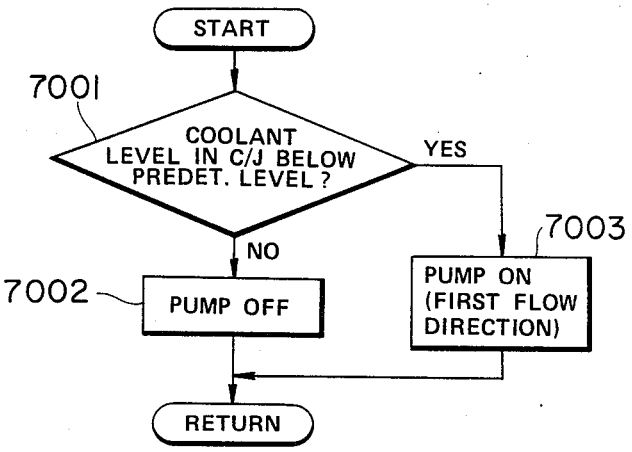

FIG. 15 shows the coolant level control routine which is run after each temperature control routine execution. At step 7001 of this program the level of the coolant in the coolant jacket 208 is determined by sampling the output of level sensor 252. If the level of coolant in the coolant jacket 208 (C/J) is below H2 then at step 7003 pump 224 is energized to pump coolant in the first flow direction from the lower tank 220 toward the coolant jacket 208. The pump 224 is left running until the next run of the coolant level control routine which of course occurs within a very short period of time. When the coolant level has been returned to level H2 the operation of the pump is stopped in step 7002.

Figure 16:
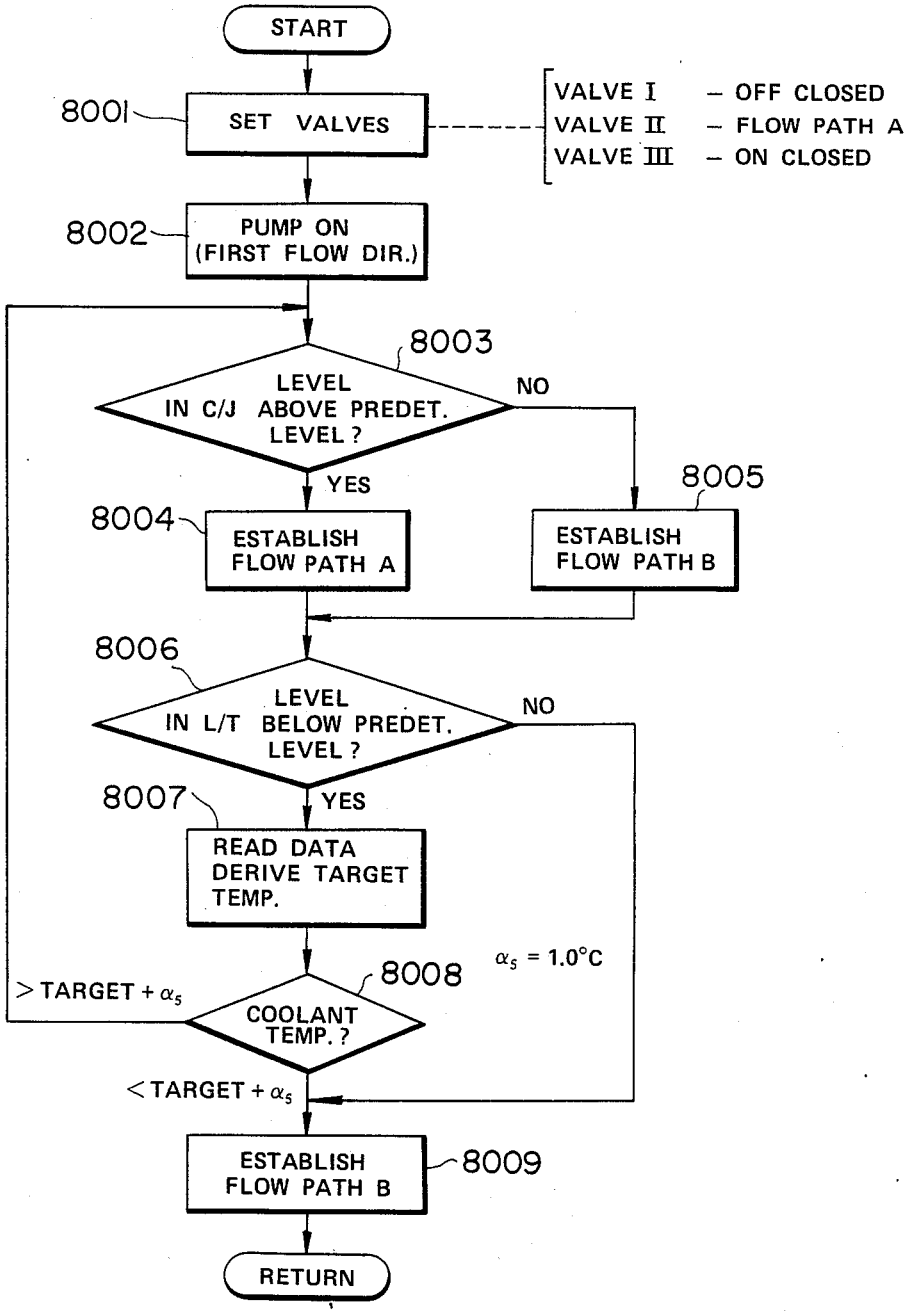

FIG. 16 shows in flow chart form the steps which characterize the control via which the level of coolant in the cooling circuit is reduced for the purposes of coolant temperature control. As shown the first step (8001) of this control routine involves the conditioning of the valves so that valve I is closed, valve II establishes flow path A and valve III is energized to assume a closed state. At step 8002 pump 224 is energized so as pump coolant in the first flow direction (viz., from the lower tank toward valve II (236). Under these conditions coolant is withdrawn from the lower tank 220 and forced out to the reservoir 226 via conduit 238.

At step 8003 the coolant level in the coolant jacket 208 is checked to determine if the level of coolant therein has dropped to H1 or not. In the event that the level has not dropped to H1 then the program flows to step 8004 wherein the setting of valve II (236) is left as is and the flow path A maintained. On the other hand, if the level in the coolant jacket has in fact dropped to level H1 then as step 8005 the position of valve II is reversed to establish flow path B and thus terminate the discharge of coolant out of the system. Subsequently at step 8006 the coolant level in the lower tank 220 is determined by sampling the output of level sensor 262. In the event that the level of coolant in the lower tank is below level H2 then the program proceeds to step 8007 wherein the outputs of sensors 258 and 260 are sampled and the TARGET temperature determined. However, if the level of coolant in the lower tank 220 is still above H2 then the program by-passes steps 8007 and 8008 as shown.

At step the instant coolant temperature is compared with the TARGET value derived in step 8007. In the event that the coolant temperature is greater than TARGET+$\alpha$5 (wherein $\alpha$5=1.0° C.) then the program returns to step 8003 in an effort to induce a further reduction in coolant and thus internal pressure while in the event that the coolant temperature is lower than TARGET+$\alpha$5 then the program flows to step 8009 wherein flow path B is established via suitable conditioning of valve II.

As will be appreciated this control strives to lower the temperature of the coolant to a value which is within 1.0° C. of the desired TARGET value and is executed in response to the temperature ranging and level sensing steps 1007 and 1008 of the system control routine shown in FIG. 9.

Figure 17:
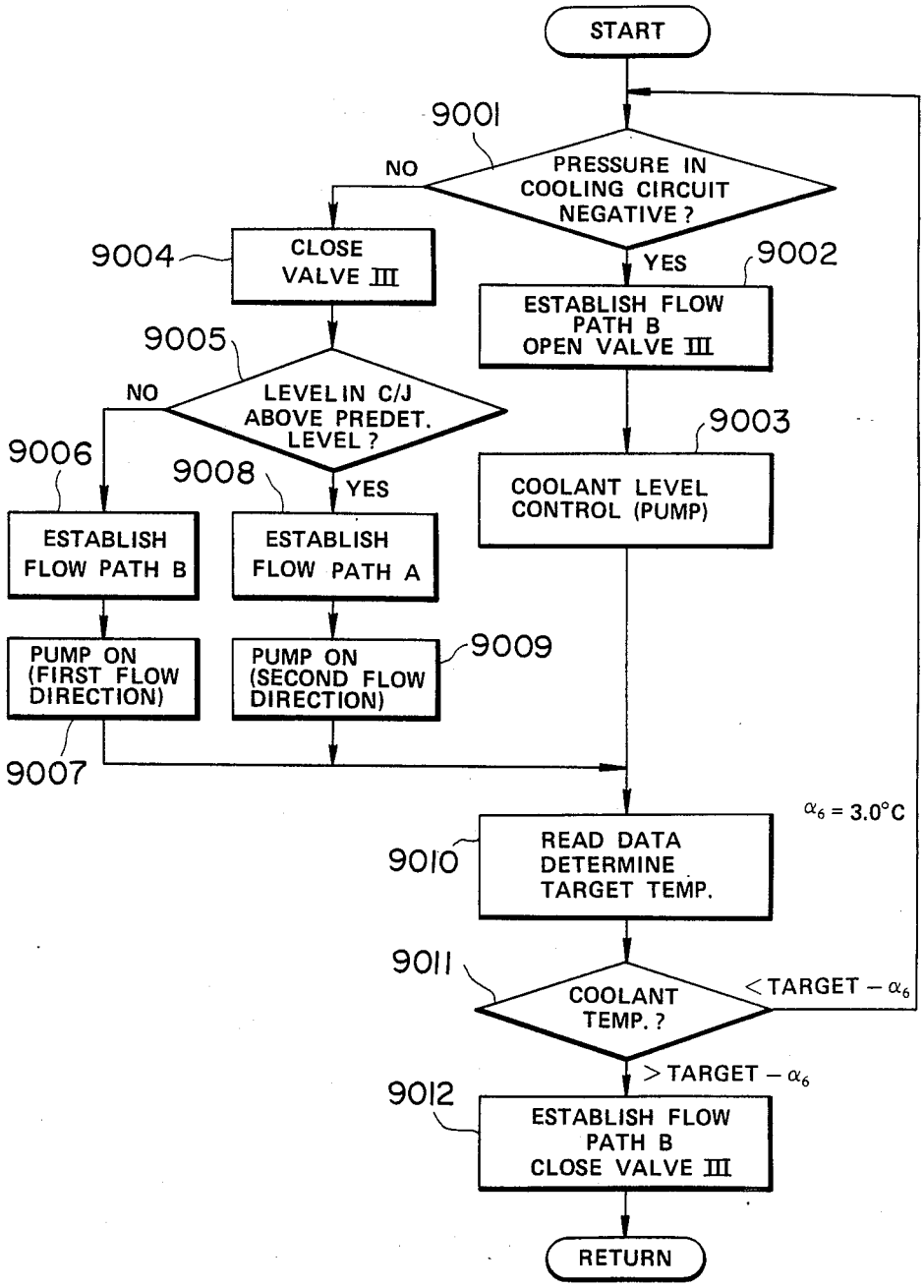

FIG. 17 shows in detail the steps which characterize the operation wherein the amount of coolant within the cooling circuit is increased in an effort to raise the pressure within the cooling circuit and thus raise the boiling point of the coolant. It will be noted that this control is executed in response to the temperature ranging executed in step 1007 of FIG. 9.

As shown, subsequent to the start of this routine the pressure prevailing in the cooling circuit is sampled and the determination as to whether the pressure is negative or not (step 9001). This of course can be determined by sampling the output of the pressure differential responsive switch 250.

In the event that the pressure within the cooling circuit is in fact negative then the program proceeds to step 9002 wherein valve II is condition to provide flow path B while valve III is de-energized to assume an open state. This permits coolant to be inducted into the coolant circiut under the influence of the pressure differential which exists between the ambient atmosphere and the interior of the cooling system. At step 9003 the coolant level control routine shown in FIG. 15 is executed.

On the other hand, if the pressure within the cooling circuit is not lower than atmospheric then at step 9004 valve III is energized so as to asume a closed state. At step 9005 the coolant level in the coolant jacket 208 is determined and if lower than H1 then at step 9006 valve II is conditioned to provide flow path B and at step 9007 pump 224 is energized in a manner to pump liquid coolant in the first flow direction. However, if the coolant level in the coolant jacket 208 is above H1 then flow path A is established and pump 224 operated to pump coolant in the second flow direction. This of course positively inducts coolant from the reservoir 226 and forces same into the cooling circuit (radiator 216) to increase the pressure prevailing therein.

At step 9010 the TARGET temperature is derived and at step 9011 the instant coolant temperature compared with the derived value. In the event that the coolant temperature is below TARGET−$\alpha$6 then the program recycles to step 9001 in order to permit further coolant to be introduced into the cooling circuit.

However, if the temperature is greater than TARGET−$\alpha$6 then at step 9012 flow path B is and valve III closed thus terminating the influx of coolant.

Figure 18:
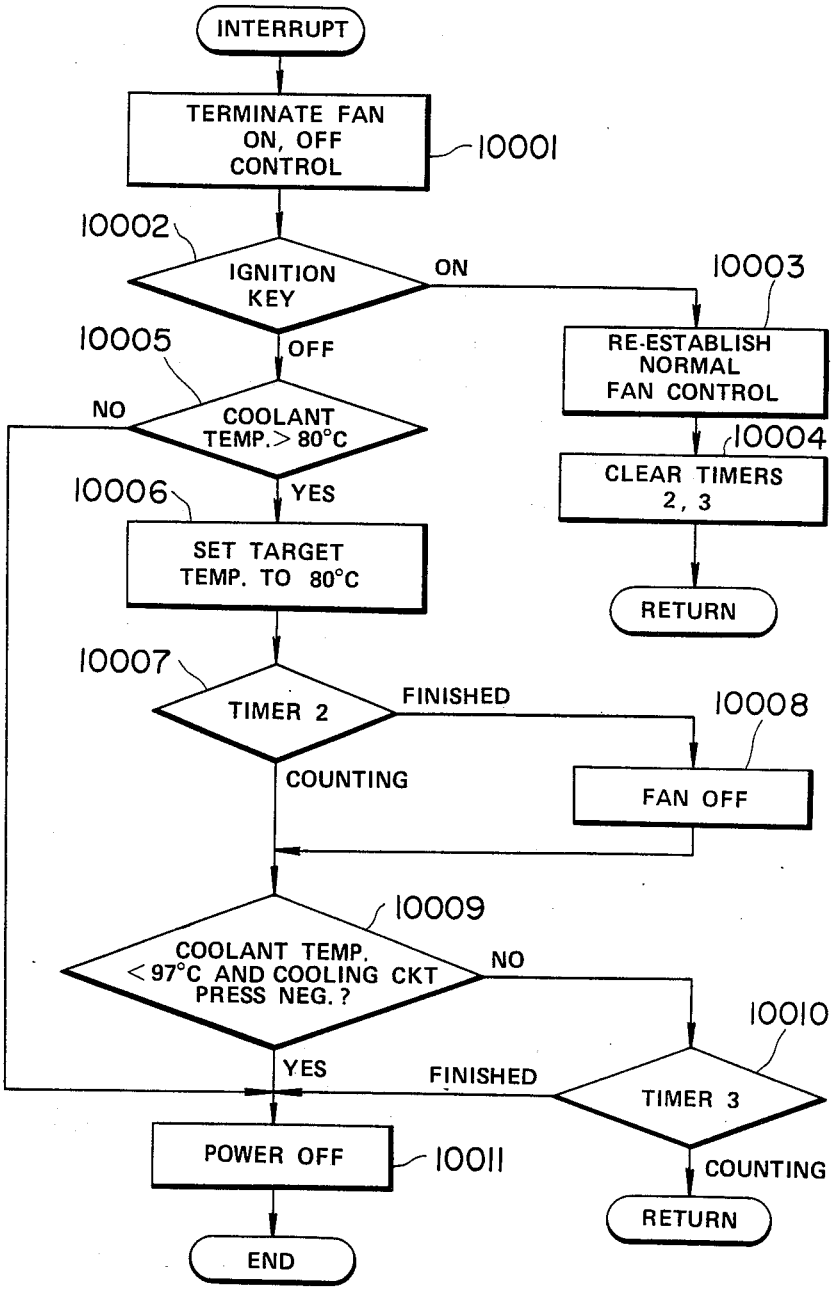

In the event that the engine stops, an interrupt is carried out as shown in FIG. 18. As will be appreciated it is necessary to determine if the engine has merely stalled and will undergo an immediate restart or has been deliberately stopped such as during parking and the like. Accordingly, at step 10001 the normal ON/OFF operation of fan 218 is terminated and the fan conditioned to continuously operate while at step 10002 the condition of the ignition key is sampled. If the key is still in the ON position it is assumed that the engine will be immediately restarted and the program flows to steps 10003 and 10004 wherein normal ON/OFF control of the fan is reinstated and timers 2 and 3 cleared.

However, if the sampling at step 10002 indicates that the ignition key is off (viz., the engine has been deliberately stopped) then at step 10005 it is determined if the temperature of the engine coolant is above a predetermined level which in this embodiment is selected to be 80° C. If the temperature of the coolant is still below the just mentioned limit it is assumed that the cooling circuit can be rendered open circuit without fear of super atmospheric pressures causing a violent displacement of coolant out of the circuit to the reservoir in a manner which invites spillage and permanent loss of coolant. On the other hand, if the coolant is still above 80° C. then the program flows to step 10006 wherein the TARGET temperature is set to the just mentioned value. At step 10007 a second timer (timer 2) is set counting. In this embodiment the period for which the second counter is arranged to count over is selected to be 1 minute. If desired this value can be increased or decreased in view of the engine which is cooled by the system according to the present invention. Upon completion of the count the operation of fan 218 is terminated in step 10008.

At step 10009 enquires relating to the temperature and pressure status of the interior of the cooling circuit are carried out. Viz., it is determined if the coolant temperature is below 97° C. and the pressure prevailing within the system negative. If both of these requirements are met then at step 10011 power to the entire system is cut off. However, if one or the other of the two requirements is not met then the program flows to step 10010 wherein timer 3 is set counting and the program goes to RETURN. The period for which the third counter is arranged to count is in this embodiment is 1 minute. When the third counter completes its count the program goes to step 10011 and terminates. Thus, as will be understood, if counter 3 is set counting the shutdown control routine may be run a number of times before the power to the entire system is cut-off. This of course ensures that the above mentioned spillage etc., will not occur.

What is claimed is:

1. In an internal combustion engine having a structure subject to high heat flux;

a cooling circuit for removing heat from said engine comprising:

a coolant jacket formed about said structure, said coolant jacket being arranged to receive coolant in liquid form and discharge same in gaseous form;

a radiator in which the gaseous coolant produced in said coolant jacket is condensed to its liquid form;

a vapor transfer conduit leading from said coolant jacket to said radiator for transfering gaseous coolant from said coolant jacket to said radiator;

a device associated with said radiator for varying the rate of heat exchange between said radiator and a cooling medium surrounding the radiator;

a liquid coolant return conduit leading from said radiator to said coolant jacket for returning coolant condensed to its liquid state in said radiator to said coolant jacket;

a reservoir the interior of which is maintained constantly at atmospheric pressure;

valve and conduit means for selectively interconnecting said reservoir and said cooling circuit, said valve and conduit means including a three-way valve disposed in said return conduit and a level control conduit leading from said three-way valve to said reservoir, said three-way valve having a first state wherein fluid communication between said radiator and said coolant jacket is interrupted and communication between said radiator and said reservoir established, and a second state wherein communication between said reservoir and said radiator is interrupted and communication between said radiator and said coolant jacket established;

a reversible pump disposed in said coolant return conduit at a location between said radiator and said three-way valve, said pump being selectively energizable to pump coolant in (a) a first flow direction from said radiator toward said three-way valve and (b) in a second flow direction from said three-way valve toward said radiator;

a first sensor for sensing a parameter which varies with the temperature of the liquid coolant in said coolant jacket;

a second sensor for sensing a parameter which varies with the load on the engine; and a control circuit responsive to said first and second sensors for controlling the operation of said device, said valve and conduit means and said pump, said control circuit including means for:

determining the operational mode of the engine;

deriving a target temperature at which the liquid coolant in said coolant jacket should be maintained;

operating said device in a manner to vary the rate of condensation in said radiator and bring the temperature of the coolant in said coolant jacket to said target temperature, and operating said three-way valve and said pump in a manner to vary the amount of coolant in said cooling circuit and therefore modify the pressure prevailing in said cooling circuit in a manner which tends to bring the temperature of the coolant to said target temperature.

2. An internal combustion engine as claimed in claim 1, wherein said valve and conduit means further comprises:

a supply conduit which leads from said reservoir to the bottom of said radiator;

a second valve disposed in said supply conduit, said valve having a first position wherein communication between said reservoir and said radiator is permitted and a second position wherein the fluid communication between said reservoir and said radiator is prevented;

an overflow conduit which fluidly communicates with said cooling circuit at a first end thereof and with said reservoir at a second end thereof;

a third valve disposed in said overflow conduit, said third valve having a first position wherein fluid communication between said cooling circuit via said overflow conduit is prevented and a second position wherein fluid communication between said cooling circuit and said radiator via said overflow conduit is permitted.

3. An internal combustion engine as claimed in claim 1 further comprising:

means responsive to the pressure differential between the interior and exterior of said cooling circuit, said pressure differential means being arranged to output a signal indicative of a predetermined pressure differential existing betweem the interior and exterior of said cooling circuit.

4. An internal combustion engine as claimed in claim 1 wherein said engine includes:

a cylinder block;

a cylinder head detachably secured to said cylinder block;

means defining cavities in said cylinder head and cylinder block which cavities define said coolant jacket; and wherein said liuqid coolant return conduit communicates with a cavity formed in said cylinder head.

5. A method of cooling an internal combustion engine comprising the steps of:

introducing liquid coolant into a cooling circuit which includes a coolant jacket formed about structure of the engine subject to high heat flux;

permitting the coolant in said coolant jacket to boil and produce coolant vapor;

transferring the coolant vapor to a radiator which defines a further section of said cooling circuit;

condensing the coolant to its liquid form in said radiator;

sensing operational parameters of said engine;

sensing the temperature of the coolant in said coolant jacket;

using the data obtained during said step of sensing operational parameters to derive a target temperature at which the coolant in said coolant jacket should be maintained under the instant set of operational conditions;

using a device located externally of said radiator to vary the rate of heat exchange between the radiator and a cooling medium surrounding said radiator in a manner which tends to bring the temperature of said coolant to said target temperature;

using a reversible pump to pump coolant into and out of said coolant circuit in a manner which varies the pressure prevailing in said cooling circuit in a manner which tends to bring the temperature of said coolant to said target temperature.

* * * * *